US010149514B2

(12) United States Patent
Adams et al.

(10) Patent No.: US 10,149,514 B2
(45) Date of Patent: Dec. 11, 2018

(54) SINGLE PULL SQUARED-CORD SHOE CLOSURE SYSTEM

(71) Applicant: Fit Squared Shoes, LLC, San Antonio, TX (US)

(72) Inventors: Thomas M. Adams, San Antonio, TX (US); Zenon O. Smotrycz, Bedford, MA (US); Eric J. Clement, Woburn, MA (US)

(73) Assignee: Fit Squared Shoes, LLC, San Antonio, TX (US)

( * ) Notice: Subject to any disclaimer, the term of this patent is extended or adjusted under 35 U.S.C. 154(b) by 56 days.

(21) Appl. No.: 15/253,178

(22) Filed: Aug. 31, 2016

(65) Prior Publication Data

US 2018/0055146 A1 Mar. 1, 2018

(51) Int. Cl.

| | |
|---|---|
| ***A43C 1/06*** | (2006.01) |
| ***A43C 7/00*** | (2006.01) |
| ***A43C 11/14*** | (2006.01) |
| ***A43C 11/00*** | (2006.01) |
| ***A43C 1/00*** | (2006.01) |
| ***A43C 11/06*** | (2006.01) |
| ***A43C 11/10*** | (2006.01) |

(52) U.S. Cl.

CPC ..... *A43C 1/06* (2013.01); *A43C 1/00* (2013.01); *A43C 7/00* (2013.01); *A43C 11/008* (2013.01); *A43C 11/06* (2013.01); *A43C 11/10* (2013.01); *A43C 11/14* (2013.01)

(58) Field of Classification Search

CPC .... A43C 11/00; A43C 11/008; A43C 11/1493

USPC ..... 36/50.1

See application file for complete search history.

(56) References Cited

U.S. PATENT DOCUMENTS

| | | | |
|---|---|---|---|
| 1,197,783 | A | 9/1916 | Winbray |
| 1,328,333 | A | 1/1920 | Mann |
| 2,096,160 | A | 10/1937 | Chambers |
| 3,703,775 | A | 11/1972 | Gatti |
| 4,079,527 | A | 3/1978 | Antonious |
| 4,282,657 | A | 8/1981 | Antonious |
| 4,308,672 | A | 1/1982 | Antonious |

(Continued)

FOREIGN PATENT DOCUMENTS

| | | | |
|---|---|---|---|
| JP | 07-124002 | A | 5/1995 |
| JP | 08266307 | A | 10/1996 |

(Continued)

*Primary Examiner* — Marie D Bays

(74) *Attorney, Agent, or Firm* — Kammer Browning PLLC

(57) ABSTRACT

A system for securing shoes to the feet using a one pull shoe closure arrangement. Each embodiment of the system uses a squared-cord arrangement that extends between the lateral and medial sides of the shoe. The various embodiments arrange a single draw strap connected to one or more squared-cord portions to draw in and tighten the sides of the squared-cord arrangement. A single pull strap in a first embodiment is redirected from a lateral orientation to a longitudinal orientation where it is drawn back and secured on the heel portion of the shoe. Alternate embodiments pull a shorter draw strap laterally to a point of securement on the side of the shoe. Further alternate embodiments pull a draw strap longitudinally along a midline at the top of the shoe to a point of securement back onto the squared-cord arrangement.

20 Claims, 14 Drawing Sheets

(56) References Cited

U.S. PATENT DOCUMENTS

| | | | | |
|---|---|---|---|---|
| 4,476,639 | A | 10/1984 | Zaccaria | |
| 4,513,520 | A | 4/1985 | Koch | |
| 4,547,981 | A | 10/1985 | Thais et al. | |
| 4,592,154 | A | 6/1986 | Oatman | |
| 4,972,613 | A | 11/1990 | Loveder | |
| 5,228,216 | A | 7/1993 | Sargeant | |
| 5,269,078 | A | 12/1993 | Cochrane | |
| 5,408,761 | A | 4/1995 | Gazzano | |
| 5,425,185 | A | 6/1995 | Gansler | |
| 5,463,822 | A | 11/1995 | Miller | |
| 5,469,640 | A | 11/1995 | Nichols | |
| 5,659,982 | A | 8/1997 | Muraoka et al. | |
| 5,755,044 | A * | 5/1998 | Veylupek | A43C 1/003 36/50.1 |
| 5,775,006 | A | 7/1998 | Breuner | |
| 5,794,360 | A | 8/1998 | Bell et al. | |
| 5,819,439 | A | 10/1998 | Sanchez | |
| 6,128,835 | A | 10/2000 | Ritter et al. | |
| 6,228,043 | B1 | 5/2001 | Townsend et al. | |
| 6,237,250 | B1 | 5/2001 | Aguerre | |
| 6,270,468 | B1 | 8/2001 | Townsend et al. | |
| 6,286,233 | B1 | 9/2001 | Gaither | |
| 6,640,466 | B1 * | 11/2003 | Liu | A43B 1/0081 36/50.1 |
| 6,671,980 | B1 * | 1/2004 | Liu | A43B 11/00 24/712 |
| 6,757,991 | B2 | 7/2004 | Sussmann | |
| 7,094,213 | B1 | 8/2006 | Cook | |
| 7,370,440 | B1 | 5/2008 | Cole, III | |
| 8,713,820 | B2 | 5/2014 | Kerns et al. | |
| 9,364,046 | B2 | 6/2016 | Adams et al. | |
| 2003/0150135 | A1 * | 8/2003 | Liu | A43B 3/0005 36/50.1 |
| 2003/0167655 | A1 | 9/2003 | Sussmann | |
| 2004/0078999 | A1 * | 4/2004 | Freed | A43C 1/003 36/50.1 |
| 2005/0126043 | A1 * | 6/2005 | Reagan | A43B 3/0031 36/50.5 |
| 2008/0066344 | A1 | 3/2008 | Kelley | |
| 2008/0110050 | A1 | 5/2008 | Prickell | |
| 2008/0189987 | A1 | 8/2008 | Geisser et al. | |
| 2008/0216351 | A1 * | 9/2008 | Carroll | A43C 1/06 36/50.1 |
| 2008/0244928 | A1 | 10/2008 | Romboli et al. | |
| 2008/0250667 | A1 | 10/2008 | Rasmussen | |
| 2008/0313926 | A1 | 12/2008 | Kelley | |
| 2009/0090029 | A1 | 4/2009 | Kishino | |
| 2009/0100707 | A1 * | 4/2009 | Bar | A43C 1/00 36/50.1 |
| 2009/0100708 | A1 | 4/2009 | Kelley | |
| 2009/0100717 | A1 * | 4/2009 | Cabanis | A63B 5/0411 36/116 |
| 2009/0272007 | A1 | 11/2009 | Beers et al. | |
| 2009/0300947 | A1 | 12/2009 | Babolat | |
| 2013/0255105 | A1 | 10/2013 | Bishop et al. | |
| 2014/0338223 | A1 | 11/2014 | Adams et al. | |
| 2015/0289594 | A1 * | 10/2015 | Rushbrook | A43C 11/22 36/50.1 |
| 2015/0289595 | A1 * | 10/2015 | Rushbrook | A43C 11/22 36/50.1 |

FOREIGN PATENT DOCUMENTS

| | | | |
|---|---|---|---|
| JP | 11-032810 | A | 2/1999 |
| JP | 2004-097498 | A | 4/2004 |
| KR | 10-1996-0700641 | A | 2/1996 |

* cited by examiner

SINGLE PULL SQUARED-CORD SHOE CLOSURE SYSTEM

BACKGROUND OF THE INVENTION

1. Field of the Invention

The present invention relates generally to shoes and systems for securing shoes to the feet. The present invention relates more specifically to structures and systems for drawing the upper components of a shoe together for shoe closure around the feet through the use of a single pull mechanism.

2. Description of the Related Art

The present invention addresses the same problems as the single pull fit adjustment systems for shoes described in U.S. Pat. No. 9,364,046; Issued: Jun. 14, 2016, in the name of Adams et al. The full disclosure of U.S. Pat. No. 9,364,046 is incorporated herein by reference.

SUMMARY OF THE INVENTION

The present invention provides a number of preferred embodiments, within a general system for securing shoes to the feet that utilize a one pull shoe closure arrangement. Each of the various alternate embodiments of the present invention utilizes what is broadly referred to as a "squared-cord" arrangement that extends between the lateral and medial sides of the shoe across the tongue or top portion of the shoe. "Squared-cord" arrangement refers to the generally rectangular arrangement of an open or closed loop of cord extending around an array of corner or side point cord capture devices. Although generally rectangular, the squared-cord arrangements described herein need not define right angles at the corners and need not have opposing sides of equal length. The arrangement may be trapezoidal or may have sides that curve inward or outward without departing from the "generally rectangular" or "squared-cord" arrangement definition set forth in this disclosure. The various alternate embodiments arrange a single draw strap connected to one or more squared-cord structures to draw in, and thereby shorten and tighten, the sides of the squared-cord arrangement from its initially loose configuration. Various structures for drawing upon or pulling on the one or more squared-cords, and for allowing the cords to slide or move from their original configuration, are described.

A number of embodiments described utilize a side strap that draws upon one side of the squared-cord configuration to effect the shoe closure. The single pull strap in a first embodiment is redirected from a lateral orientation (across the shoe) to a longitudinal orientation (along the shoe) where it is drawn back with a longitudinal motion and secured on the side and/or heel portion of the shoe. Alternate embodiments pull a shorter draw strap laterally to a point of securement on the side of the shoe below the tongue area without the need for a longitudinal pull motion. Further alternate embodiments pull a draw strap longitudinally along a midline at the top of the shoe to a point of securement back onto the squared-cord arrangement. Again, various structural mechanisms for effecting the drawing together of the squared-cord configurations are anticipated and described.

DETAILED DESCRIPTION OF THE PREFERRED EMBODIMENTS

Figure 1:
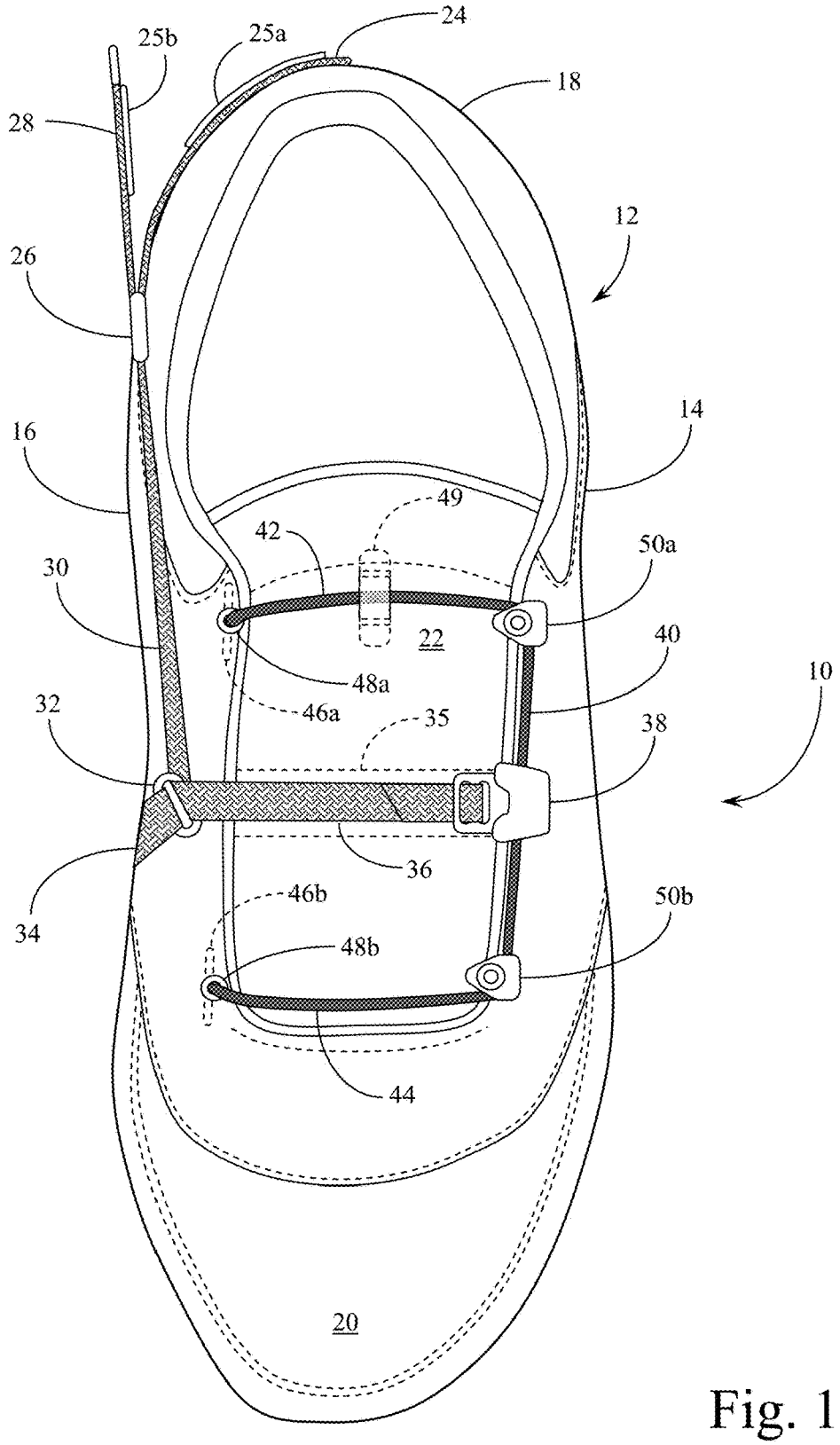
FIG. 1 is a top plan view of a first preferred embodiment of the squared-cord shoe closure system of the present invention shown in an open and loose configuration.

Reference is made first to FIG. 1 which provides a top plan view of a first preferred embodiment of the squared-cord shoe closure system of the present invention shown in a generally open and loose configuration, ready for insertion of the user's foot into the shoe prior to closure. Shoe closure system 10 is positioned on shoe 12 (left foot shoe shown in the example provided) with a lateral side 14 of the shoe and a medial side 16. Heel portion 18 of the shoe is also shown at the top of FIG. 1 with toe portion 20 of the shoe shown at the bottom. Tongue portion 22 of the shoe is shown within and beneath the shoe closure system 10 of the present invention.

The overall shoe closure system 10 starts with strap components that are fixed to the heel portion 18 of shoe 12 and extend forward to approximately the middle of the shoe on medial side 16. Those skilled in the art will recognize that the structures described in FIG. 1, with the side strap components positioned on the medial side of the shoe, may be reversed in their entirety to operate on or from the lateral side of the shoe. When operated from the lateral side, the squared-cord components are likewise reversed in orientation across the top or tongue portion of the shoe.

The side strap components of the shoe closure system 10 include anchor strap 24 which extends from a point on heel portion 18 of the shoe where it is sewn or otherwise fixed to the structure of the shoe. Anchor strap 24 extends forward around the heel to rear strap buckle 26 where it passes through the buckle and is reversed in direction to end with rear strap pull back portion 28. In a preferred embodiment, rear strap pull back portion 28 is secured against anchor strap 24 with attachment surfaces 25*a* & 25*b*. Various types of flexible or semi-rigid attachment surfaces may be used to secure rear strap pull back portion 28 tightly against heel portion 18 of the shoe. In some embodiments, especially with smaller shoes for children and the like, buckle 26 and anchor strap 24 may be eliminated altogether, with rear strap pull back portion 28 formed from an end of draw strap longitudinal portion 30 to draw the strap portion of the squared-cord system of the present invention longitudinally along the side of the shoe and thereafter be secured (through attachment surface 25*b* positioned on the strap) directly to attachment surface 25*a* which may be fixed directly to an area of the heel portion 18 of the shoe 12.

Figure 2:
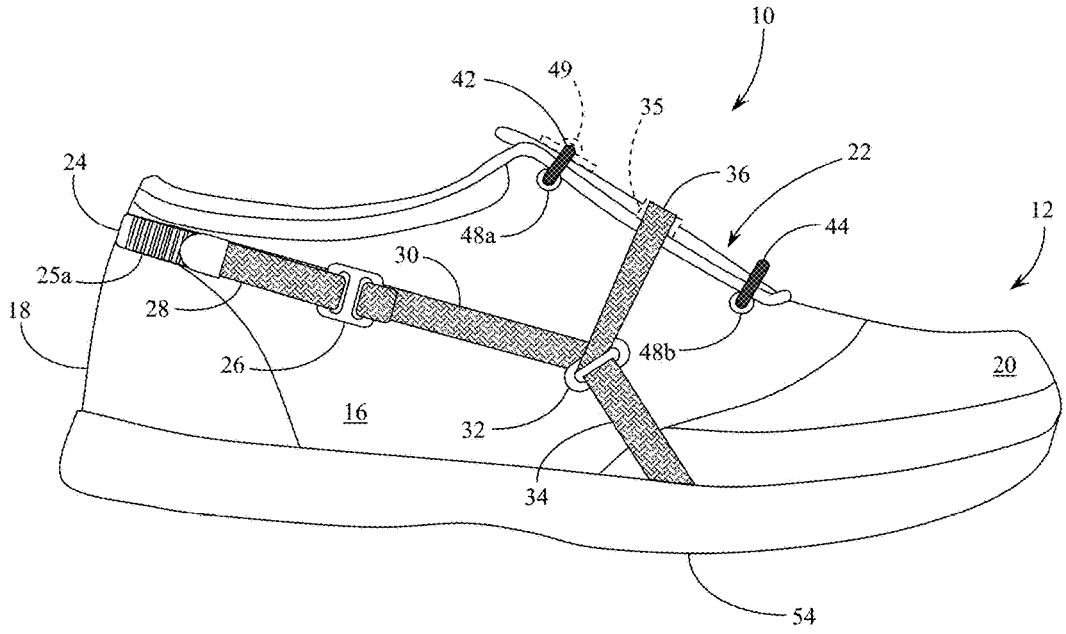
FIG. 2 is a side elevational view of the first preferred embodiment of the squared-cord shoe closure system of the present invention, as provided in FIG. 1, showing the redirection of the draw strap from a lateral orientation to a longitudinal orientation.

In the preferred embodiment shown in FIG. 1, the longitudinal pull effected by the strap arrangement described above operates on rear strap buckle 26 which is connected to and forms the end point for draw strap longitudinal portion 30. The draw strap that extends from rear strap buckle 26 to cord clasp 38 is made up of two portions; a first longitudinal portion, draw strap longitudinal portion 30; and a second lateral portion, draw strap lateral portion 36. The orientation of the overall strap is altered at angle loop buckle 32. Angle loop buckle 32 is held in place by holding strap 34 which extends from buckle 32 to a point on the side of the shoe (see FIG. 2) where it is secured either to the side of the shoe or at a point where the sole of the shoe meets the upper of the shoe. Alternately, angle loop buckle 32 may simply be secured to the side of the shoe with a rivet or other attachment component (not shown) fixing it in the same position shown in FIGS. 1 & 2. The strap and cord arrangement shown in FIGS. 1 & 2 is structured to be removable and reversible (switching from the medial to the lateral side of the shoe).

After the draw strap changes its orientation within angle loop buckle 32 from the longitudinal orientation of draw strap longitudinal portion 30 to the lateral orientation of draw strap lateral portion 36, the strap terminates with its attachment to cord clasp 38. In the preferred embodiment, draw strap lateral portion 36 extends across the tongue portion 22 of the shoe in a lateral orientation to a point where it engages the squared-cord components of the present invention. In the preferred embodiment shown in FIG. 1, the length of draw strap lateral portion 36 may be independently adjusted by moving the position of cord clasp 38 on the end of the strap.

As seen in FIG. 1, the squared-cord structure itself is made up of a single length of draw cord that includes draw cord longitudinal portion 40, draw cord rear lateral portion 42, and draw cord forward lateral portion 44. This single length of draw cord extends from cord end post 46*a* all the way through to cord end post 46*b*. Cord end posts 46*a* & 46*b* are positioned on the shoe within cord end eyelets 48*a* & 48*b*. The manner in which these end sections of the cord are inserted into and secured within the end eyelets may vary from a fixed sewn-in attachment structure to the preferred toggle post configuration shown in broken lines in FIG. 1.

The single draw cord structure of the first preferred embodiment extends between the end posts and end eyelets through fixed pulleys 50*a* & 50*b*. The draw cord slides easily through fixed pulleys 50*a* & 50*b* as well as sliding through cord clasp 38. Additional detail regarding the structures of the fixed pulleys and the cord clasp are provided below. Alternate structures that may be positioned where fixed pulleys 50*a* & 50*b* are shown in FIG. 1, are also described in more detail below.

Two additional structures shown in broken lines in FIG. 1 show components that may optionally be incorporated into the system to facilitate smooth functionality. Tongue cord guide 49 may be secured to an upper portion of tongue 22 of the shoe to prevent the tongue from sliding down below the closure system in both the loosened and tightened condition. Elastic strap 35 may be positioned across the tongue 22, each end of which is attached to opposing eye stays of the shoe to preference together the sides of the shoe (at the eye stays) when the squared-cord closure system is loose.

In the generally loose configuration shown in FIG. 1, it can be seen how the squared-cord components of the system of the present invention may be easily attached to and removed from the basic shoe structure, such that the squared-cord may be removed and replaced for functional wear or for aesthetic purposes. Cord clasp 38 may be easily removed from draw cord longitudinal portion 40 and the ends of the cord 46*a* & 46*b* may be easily removed from the end eyelets 48*a* & 48*b* positioned on the shoe 12.

Reference is next made to FIG. 2 which is a side elevational view of the first preferred embodiment of the squared-cord shoe closure system of the present invention, as shown above in FIG. 1, disclosing the manner of redirecting the draw strap from a lateral orientation to a longitudinal orientation. Shoe closure system 10 is again shown structured on shoe 12 with the view of FIG. 2 being of the medial side 16 of the shoe. Heel portion 18 and toe portion 20 of the shoe are also disclosed. The top of tongue portion 22 of the shoe is seen in profile.

Anchor strap 24, mostly covered in this view by attachment surface 25*a*, is shown where it is fixed to heel portion 18 of the shoe, extending to or around the heel and then forward in a longitudinal direction along the length of the shoe towards rear strap buckle 26. Anchor strap 24 then redirects backwards through rear strap buckle 26 to terminate in rear strap pull back 28. As described above, various mechanisms for securing rear strap pull back 28 onto or tightly against anchor strap 24 are anticipated. Rear strap buckle 26 may be a simple double loop buckle as shown, or may be structured as a friction imparting buckle to facilitate maintaining the pull strap in a secure position. A further alternate embodiment wherein rear strap buckle 26 is omitted entirely and a single strap extends back to attachment surface 25*a* is also anticipated and described above.

Extending forward of rear strap buckle 26 is the draw strap made up of draw strap longitudinal portion 30 and draw strap lateral portion 36. Effecting the change of direction from longitudinal to lateral for the draw strap is angle loop buckle 32. Holding angle loop buckle 32 in place at an approximate mid-point of medial side 16 of shoe 12 is holding strap 34 which in a preferred embodiment extends from the buckle to a fixed attachment point at the interface between the upper of medial side 16 and shoe sole 54 or to a tab (not shown) extending upwards from the juncture of the upper and the outsole.

In the fully opened and loose configuration shown in FIG. 2, many of the operative squared-cord components of shoe closure system 10 are not seen. Seen from the side in the view of FIG. 2 are cord end eyelets 48*a* & 48*b* positioned in the eye stay of the shoe adjacent the tongue portion 22 through the upper of the medial side 16 of the shoe. Positioned within eyelets 48*a* & 48*b* are cord end posts (not shown in FIG. 2) from which extend draw cord rear lateral portion 42 and draw cord forward lateral portion 44. Draw cord lateral portions 42 & 44 extend over and across tongue portion 22 of the shoe. Likewise, draw strap lateral portion 36 extends over and across tongue portion 22 of the shoe to its point of attachment to draw cord longitudinal portion (not shown). Optional elastic strap 35 is shown generally below the area where draw strap lateral portion 36 crosses over tongue 22. Optional tongue cord guide 49 is also seen (broken line form) in profile in the view of FIG. 2.

Figure 3:
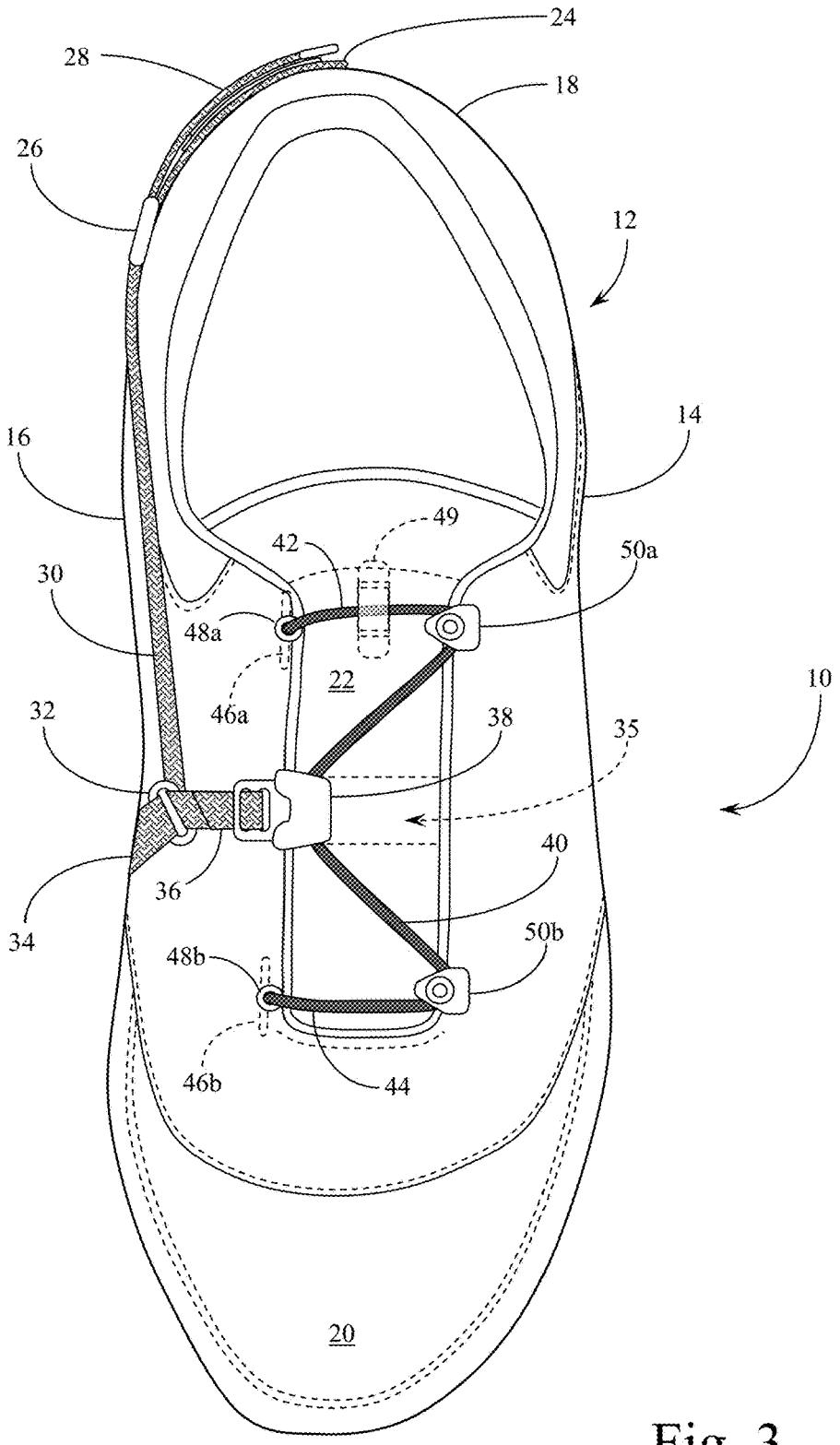
FIG. 3 is a top plan view of the first preferred embodiment of the squared-cord shoe closure system of the present invention, as provided in FIG. 1, shown in a closed and tightened configuration.

Reference is next made to FIG. 3 which is the same top plan view of the first preferred embodiment of the squared-cord shoe closure system shown in FIG. 1, but in a closed and tightened configuration after the user's foot has been inserted into the shoe and the single pull longitudinal motion has been effected to draw the shoe closed. Once again, shoe closure system 10 is positioned on shoe 12 between lateral side 14 and medial side 16 of the shoe. Heel portion 18 of the shoe is again shown at the top of FIG. 3 with toe portion 20 shown at the bottom. Tongue portion 22 of the shoe is shown within and beneath the shoe closure system 10 of the present invention.

In the closed configuration shown in FIG. 3, rear strap pullback portion 28 is drawn back against rear strap buckle 26 which pulls draw strap longitudinal portion 30 as described above. Rear strap pull back portion 28 is removeably secured to anchor strap 24 which extends from a point on heel portion 18. As indicated above, various mechanisms for securing rear strap pull back portion 28 to anchor strap 24 or to an attachment surface on heel 18 are anticipated.

The longitudinal pull on draw strap longitudinal portion 30 is redirected by angle loop buckle 32 held in place by holding strap 34. Draw strap longitudinal portion 30 transitions into draw strap lateral portion 36 which is secured to cord clasp 38 as shown. In the closed configuration shown in FIG. 3 cord clasp 38 has moved laterally across the shoe, pulling with it draw cord longitudinal portion 40. The process of pulling on draw cord longitudinal portion 40 angles the longitudinal cord and thereby pulls on and shortens both draw cord rear lateral portion 42 and draw cord forward lateral portion 44. These cord components slide through fixed pulleys 50*a* & 50*b* at the corners of the squared-cord configuration. The process of pulling on and shortening draw cord rear and forward lateral portions 42 & 44 serves to pull the two sides of the shoe together across the tongue 22 of the shoe, thereby tightening the shoe and securing it to the wearer's foot. Optional elastic strap 35 and tongue cord guide 49 are also disclosed in FIG. 3.

Figure 4A:
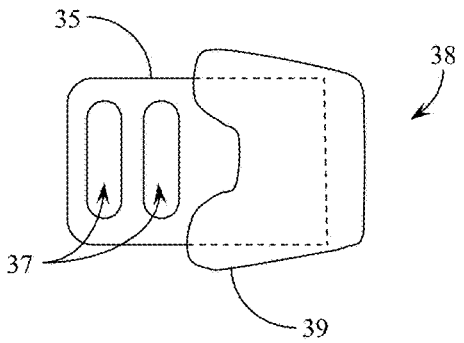
FIGS. 4A & 4B are detailed views of the squared-cord clasp of the first preferred embodiment of the present invention, as provided in FIG. 1.
Figure 4B:
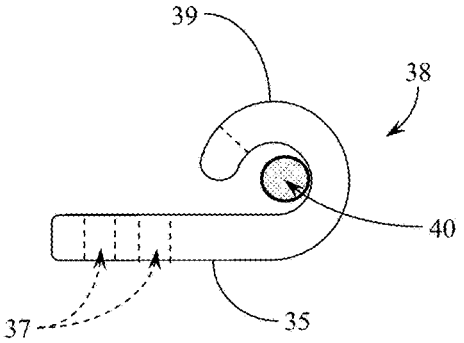

Reference is next made to FIGS. 4A & 4B which provide additional detail on cord clasp 38. Clasp 38 is generally configured as a hook device with a flat base 35 that includes strap length adjustment and securement apertures 37. Hook portion 39 of clasp 38 turns back on base 35 leaving a vertical gap sufficient to allow cord 40 to slide into and become engaged by clasp 38. The configuration shown in FIGS. 4A & 4B allows for the clasp to be removably positioned about the cord for reorientation or replacement as needed.

Figure 5A:
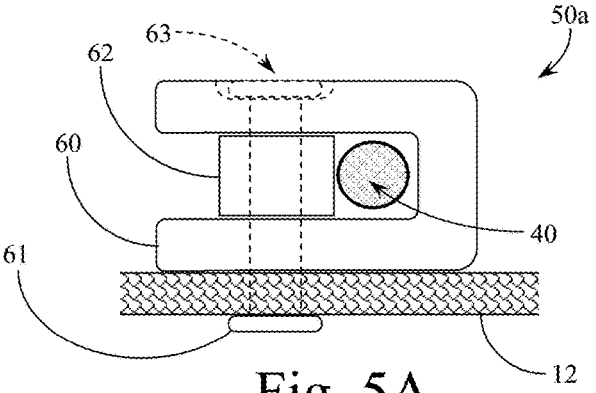
FIGS. 5A-5C are detailed views of three alternate structures for the corner points of the squared-cord arrangement of the various preferred embodiments of the present invention.
Figure 5B:
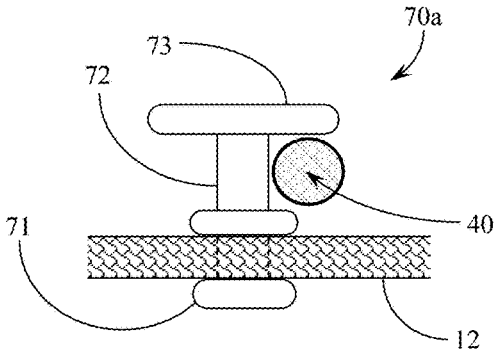
Figure 5C:
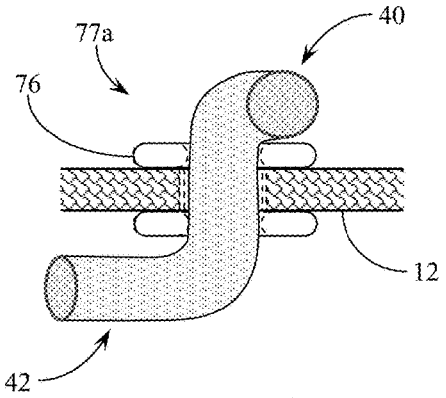

FIGS. 5A-5C provide additional detail on three alternate embodiments of the sliding corner point cord securement devices. FIG. 5A discloses fixed pulley 50*a* as shown in FIGS. 1 & 3. In this partial cross sectional view, fixed pulley 50*a* is seen to be made up of pulley block 60 which holds rotatable cylinder 62, maintained in place by pulley axle 61. Pulley axle 61 serves as both the axle for the pulley and the manner of securing fixed pulley 50*a* to the upper of shoe 12. Pulley axle 61 may be a rivet for example that is secured to the shoe through fixed pulley 50*a*. Preferably, the upper surface of the pulley block 60 includes a recessed portion 63 to receive the head of the pulley axle/rivet as shown. In the embodiment shown in FIG. 5A, cord 40 is threaded through block 60 of fixed pulley 50*a* in a manner that prevents its easy removal from or rethreading through the corner or side point structure. Alternate embodiments of the system shown in FIGS. 1-3 reorient the fixed pulley structure 50*a* such that the open side of pulley block 60 is directed outward in the corner point position. In this alternate manner of orienting fixed pulleys 50*a* & 50*b*, cord 40 may simply be secured around the corner point pulleys by drawing or stretching the cord around from the outside of the rotatable cylinder 62.

FIG. 5B presents a simpler manner of effecting corner or side point securement of cord 40 by providing a post structure that is again secured to the upper of shoe 12 in the manner of a rivet or the like. Corner post 70*a* shown in FIG. 5B comprises post pin 72 at one end of which is configured post cap 73. Rivet portion 71 is shown extending through the material of shoe 12 in a manner that secures corner post 70*a* in a tight upright configuration where it retains cord 40 as long as the cord is in a tensioned state. In a loose configuration, cord 40 may more easily be removed from corner post 70*a* in a manner that may be desirable in a number of the preferred embodiments.

Further, FIG. 5C shows yet another configuration for creating a corner or side point for cord 40 in a manner that effects the right angle reorientation of the cord at the corners or sides of the squared-cord profile. FIG. 5C discloses corner or side point aperture 77*a* which is made up primarily of a simple grommet 76 secured through the upper of shoe 12 in a manner that allows draw cord lateral portion 42 (for example) to pass upward through grommet 76 before exiting as draw cord longitudinal portion 40 where it is then directed down the length of the shoe to a corresponding aperture grommet on the lower portion of the shoe near the eye stay and the base of the tongue.

The various alternate embodiments for the corner or side points in the squared-cord system of the present Invention disclosed in FIGS. 5A-5C balance the benefits of simplicity of construction with the benefits of frictionless movement around the corner point. Each of the specific configurations described enjoy certain benefits over the others in specific shoe types and shoe sizes. It is also possible to mix the types of corner or side points in a given squared-cord arrangement.

Figure 6:
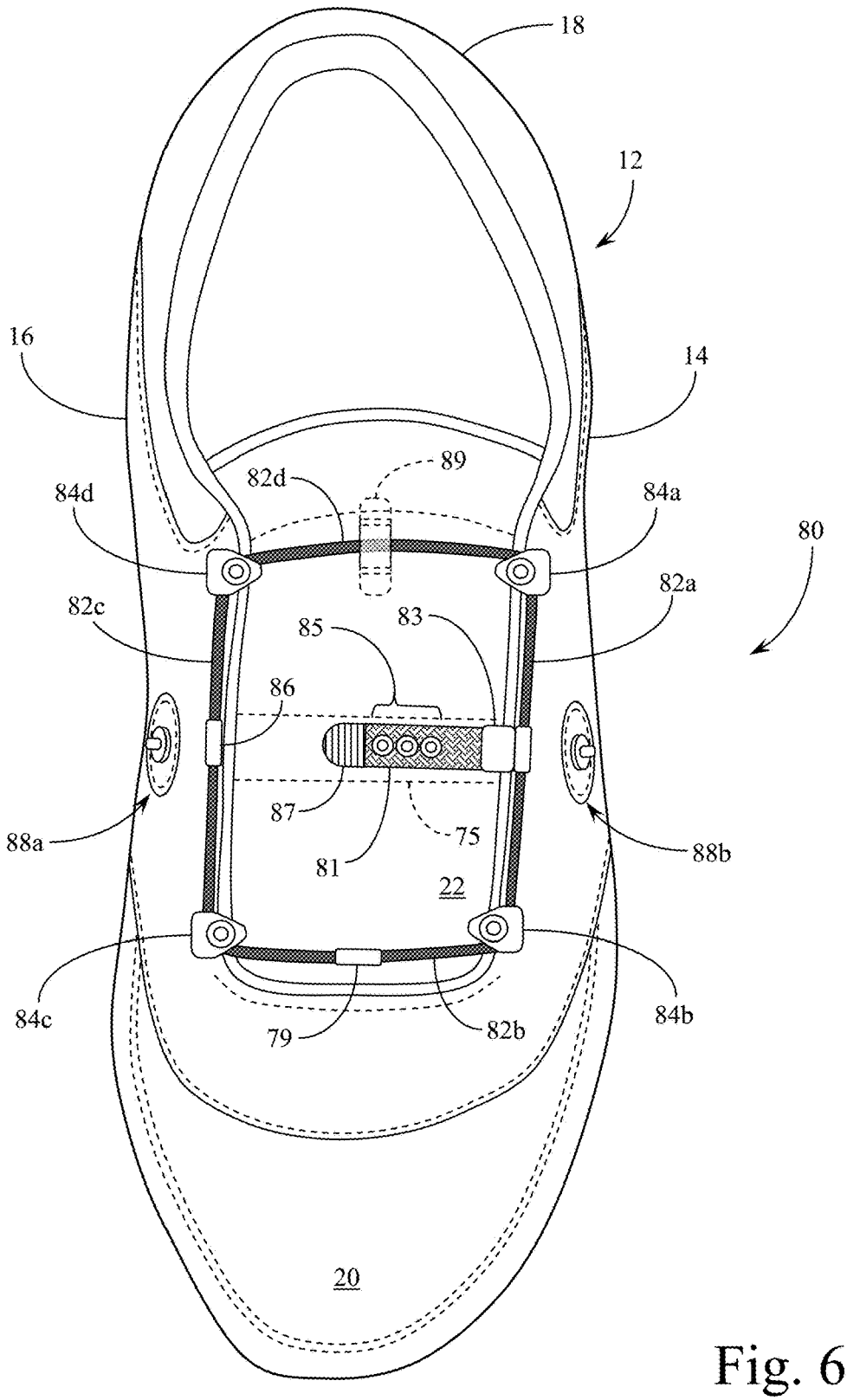
FIG. 6 is a top plan view of a second preferred embodiment of the squared-cord shoe closure system of the present invention incorporating a single lateral pull with attachment on the side of the shoe, shown in an open and loose configuration.

Reference is next made to FIG. 6 for a top plan view of a second preferred embodiment of the squared-cord shoe closure system of the present invention incorporating a single lateral pull with securement on the side of the shoe, shown in an open and loose configuration ready for insertion of the user's foot in the shoe prior to closure. Shoe closure system 80 is positioned on shoe 12 (left foot shoe shown in the example of FIG. 6) with a lateral side 14 of the shoe and a medial side 16. Heel portion 18 and toe portion 20 are also shown in their respective orientations in FIG. 6. Tongue 22 of the shoe is again shown within and beneath the shoe closure system 80 of the present invention.

In the second preferred embodiment shown in FIG. 6, the overall shoe closure system 80 eliminates the strap components that extended longitudinally down the side of the shoe and were fixed to a point on the heel of the shoe as in the first preferred embodiment described above. This second embodiment instead provides a single shorter lateral strap that is secured to the cord in a manner similar to the first preferred embodiment, but which is structured to be attached to a securement point on one side of the mid-sole portion of the shoe.

The squared-cord arrangement shown in FIG. 6 comprises a closed loop structure wherein the cord is made up of draw cord first longitudinal portion 82*a*, draw cord forward lateral portion 82*b*, draw cord second longitudinal portion 82*c*, and draw cord rear lateral portion 82*d*. The cord material is secured back onto itself with cord crimp connector 79, preferably placed at a midpoint on draw cord forward lateral portion 82*b*. The cord in this configuration is established in a rectangular geometry by threading through or securing around corner points that form the square. In the embodiment shown in FIG. 6 there are four fixed pulleys 84*a*-84*d* constructed in the manner described above with the first preferred embodiment and FIG. 5A. Each of the alternate corner points described above with the first preferred embodiment may also be applicable to the embodiment shown in FIG. 6.

Securement strap 81 includes pull tab 87, aperture array 85, and strap clasp 83. Securement strap 81 is designed to be secured (with strap clasp 83) alternately to draw cord first longitudinal portion 82*a* or draw cord second longitudinal portion 82*c* depending upon the direction of the lateral pull that the user desires to implement. Securement assemblies are therefore positioned on each side of the shoe to allow the user to draw laterally across the shoe from the outside (the lateral side of the shoe) to the medial side of the shoe, or to reverse the process directing the tightening strap laterally from the medial side towards the outside (lateral) of the shoe. Cord guard 86 provides an optional connection point on draw cord second longitudinal portion 82*c* onto which strap clasp 83 may be alternately secured to effect the reverse of the lateral draw direction (using securement post assembly 88*b* instead of 88*a*).

The manner of connecting securement strap 81 to the side of the shoe is provided by one of securement post assemblies 88*a* & 88*b* and is initiated by pulling laterally on securement strap 81, over and across draw cord second longitudinal portion 82*c* (in the orientation shown in FIG. 6). The manner in which the securement mechanisms are utilized is described in more detail below with reference to FIG. 7. Tongue cord guide 89 and elastic band 75 are again shown in broken lines as optional additions to shoe closure system 80. In the open configuration shown in FIG. 6 elastic strap 75 is shown positioned beneath securement strap 81 in a manner that retains some tension in the system, drawing the sides of the shoe opening and the shoe eye stays together even when the cord closure system is not tightened. Tongue cord guide 89 is also disclosed in FIG. 6 positioned in a manner similar to the first preferred embodiment described above wherein the tongue 22 of the shoe is held up by the residual tension in draw cord rear lateral portion 82*d*.

Figure 7:
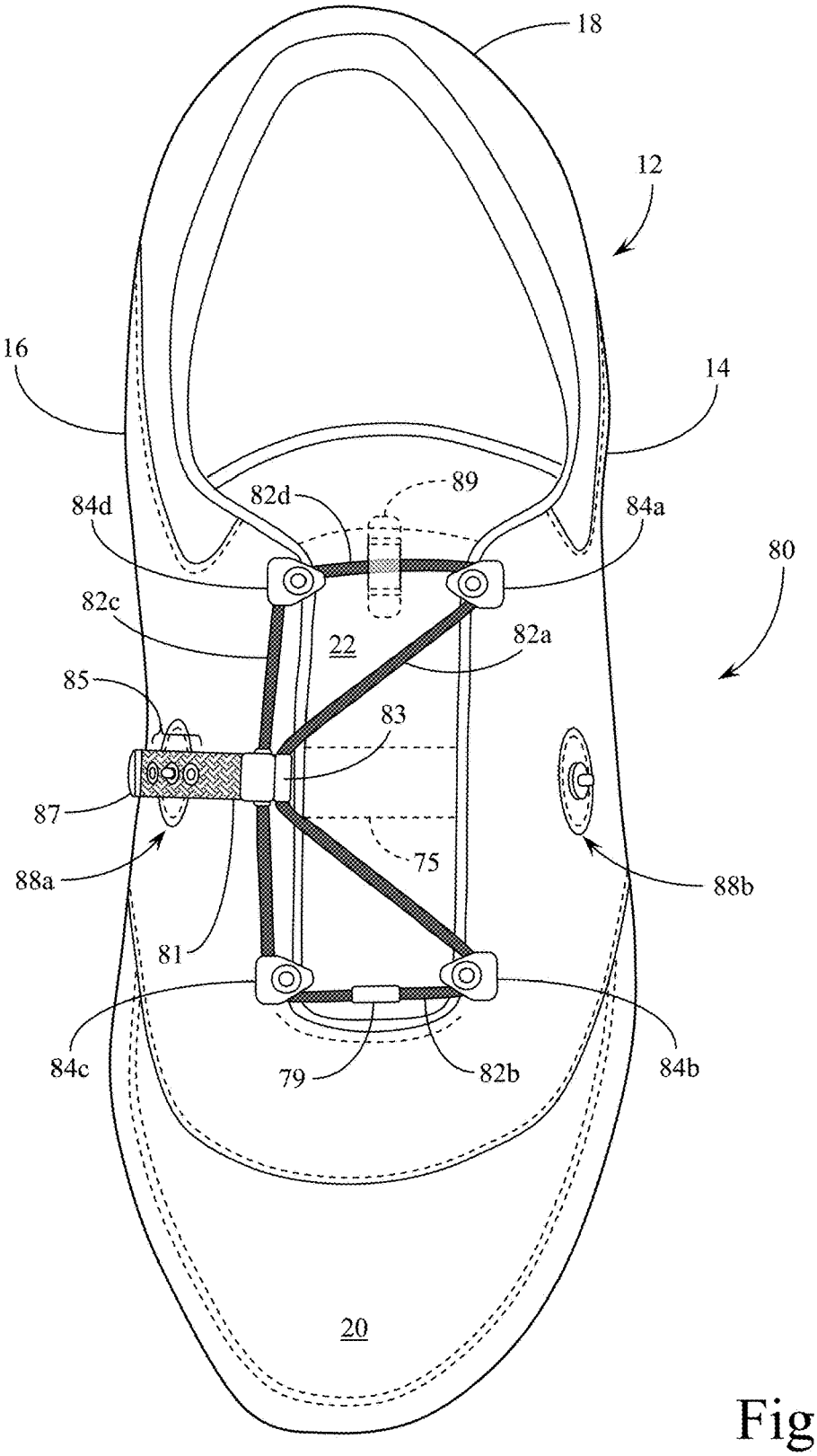
FIG. 7 is a top plan view of the second preferred embodiment of the squared-cord shoe closure system of the present invention, as provided in FIG. 6, shown in a closed and tightened configuration.

Reference is next made to FIG. 7 which represents the second preferred embodiment shown in FIG. 6 in a tightened and closed configuration. Securement strap 81 is drawn laterally across the shoe pulling on draw cord first longitudinal portion 82*a* and thereby tightening and shortening draw cord rear lateral portion 82*d* and draw cord forward lateral portion 82*b*. This single pull lateral movement compresses the lateral side 14 of the shoe towards the medial side 16. When securement strap 81 is drawn to the side, it extends down and over securement post assembly 88*a*. The user hooks one of the apertures in aperture array 85 over the hook post on securement post assembly 88*a* in order to fix the strap in its lateral tensioned position. Any number of apertures may be configured in linear aperture array 85.

In the preferred embodiment of the present invention shown in FIGS. 6 & 7, the closed loop draw cord (made up of cord portions 82*a*-82*d*) is preferably an elastic or semi-elastic cord that when tightened and pulled in the manner shown in FIG. 7, imparts a residual tension in the cord that serves to not only draw the sides of the shoe together over tongue 22, but also to maintain a snug fit to the shoe and to effect a tension force on securement strap 81 that helps to maintain it in position on securement post assembly 88*a*. Those skilled in the art will recognize that the elasticity of the draw cord should be a balance between having a residual tension in the cord once drawn across the shoe and attached in the manner described above, and the ability to draw the sides of the shoe together over the tongue by effectively shortening draw cord forward lateral portion 82*b* and draw cord rear lateral portion 82*d*. Too much elasticity and the cord merely stretches once securement strap 81 is drawn into position without drawing the sides of the shoe tightly enough across the tongue. Not enough elasticity and there is no residual tension remaining in the cord once it is drawn across and secured. Various cord structures combining interior elastic fibers within a woven polymer thread sheath meet this preferred balance of elastic properties. It should also be noted that the closed loop configuration shown in FIGS. 6 & 7 may be implemented with the longer draw strap configuration positioned on the side of the shoe shown and described with FIGS. 1-3.

Figure 8A:
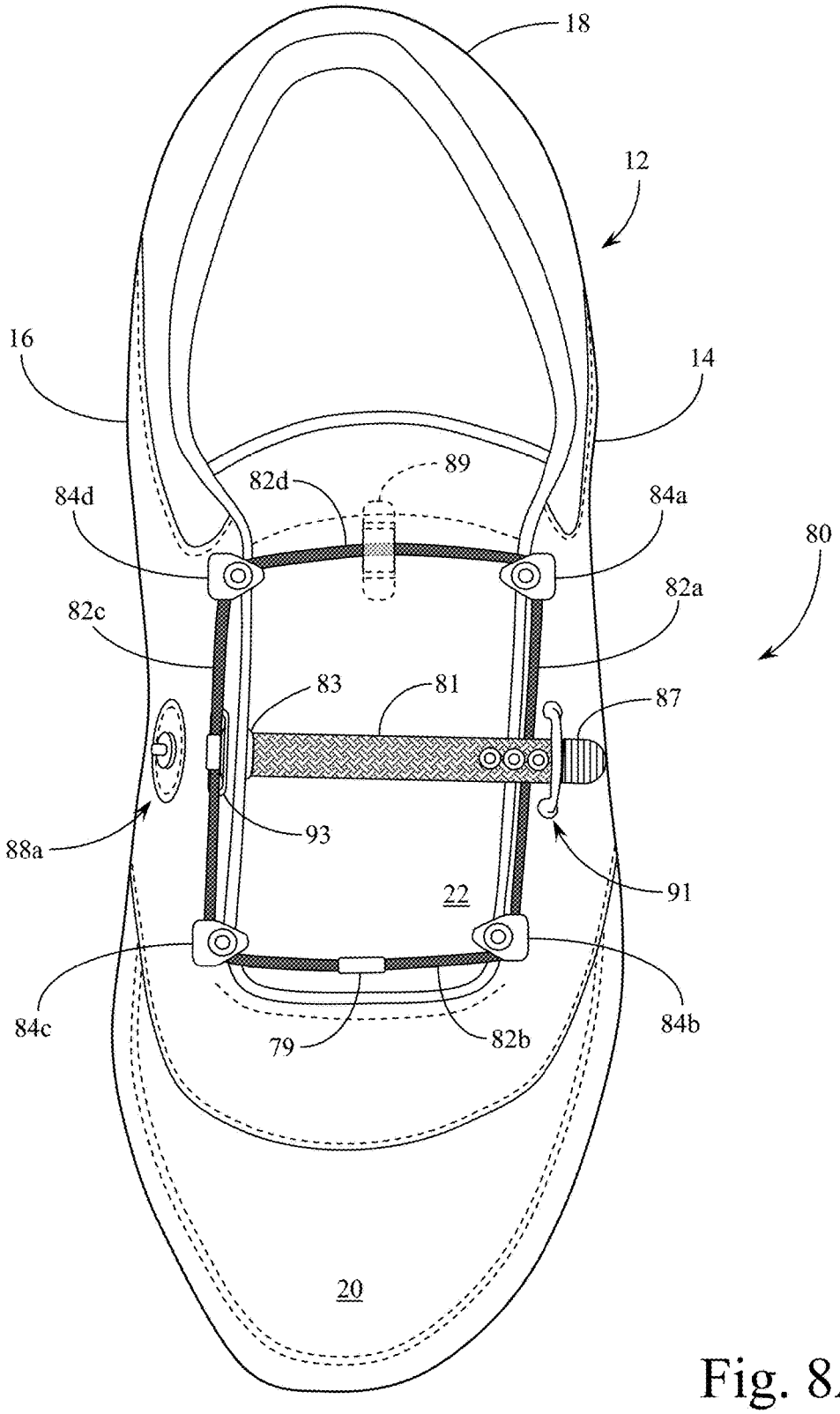
FIG. 8A is a top plan view of a third preferred embodiment of the squared-cord shoe closure system of the present invention, incorporating a single lateral pull with attachment on the side of the shoe, supplemented with an additional lateral closure action, shown in an open and loose configuration.
Figure 8B:
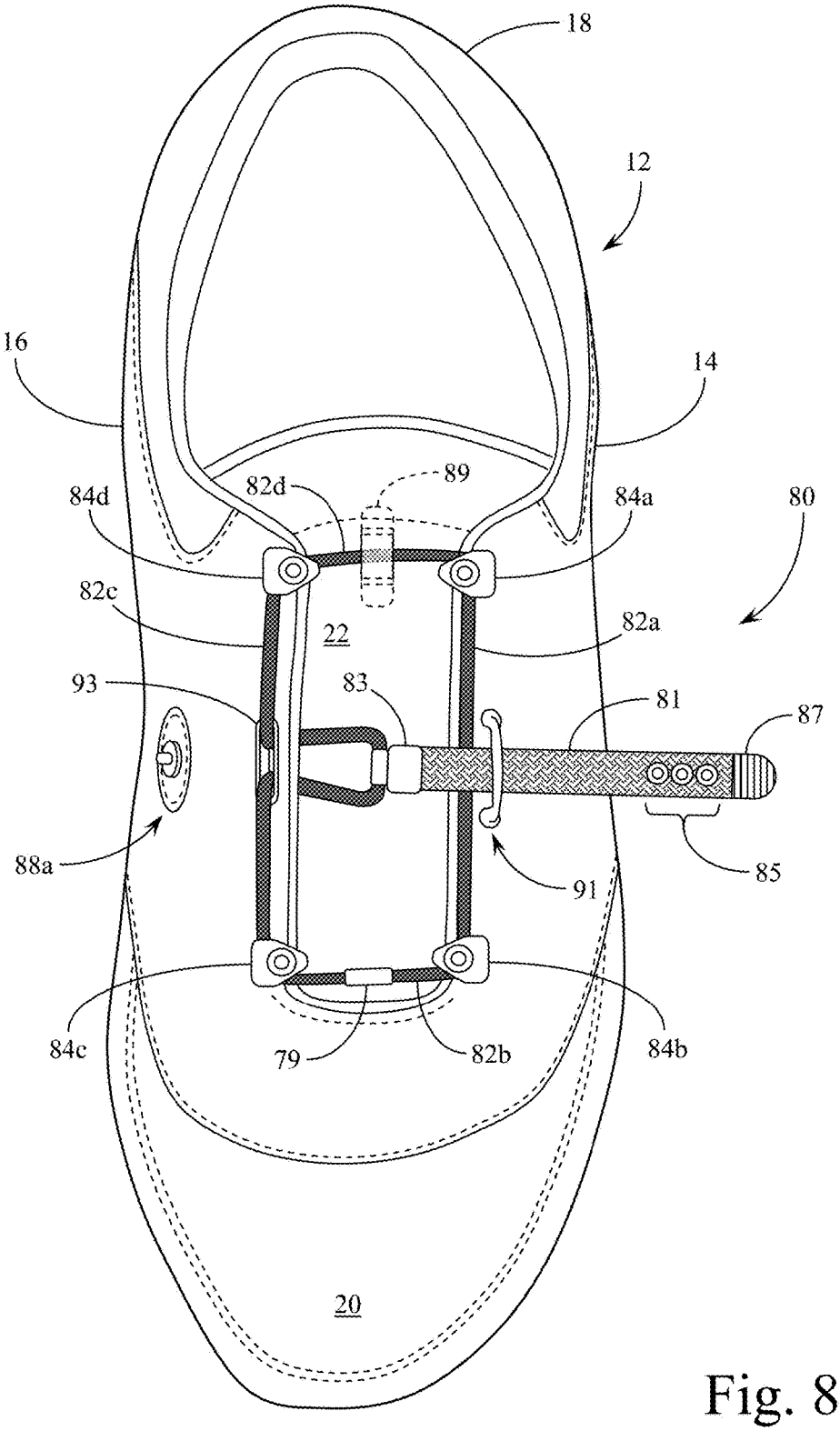
FIG. 8B is a top plan view of the third preferred embodiment of the squared-cord shoe closure system of the present invention, as provided in FIG. 8A, shown in a condition mid-way between an open and a closed configuration.
Figure 8C:
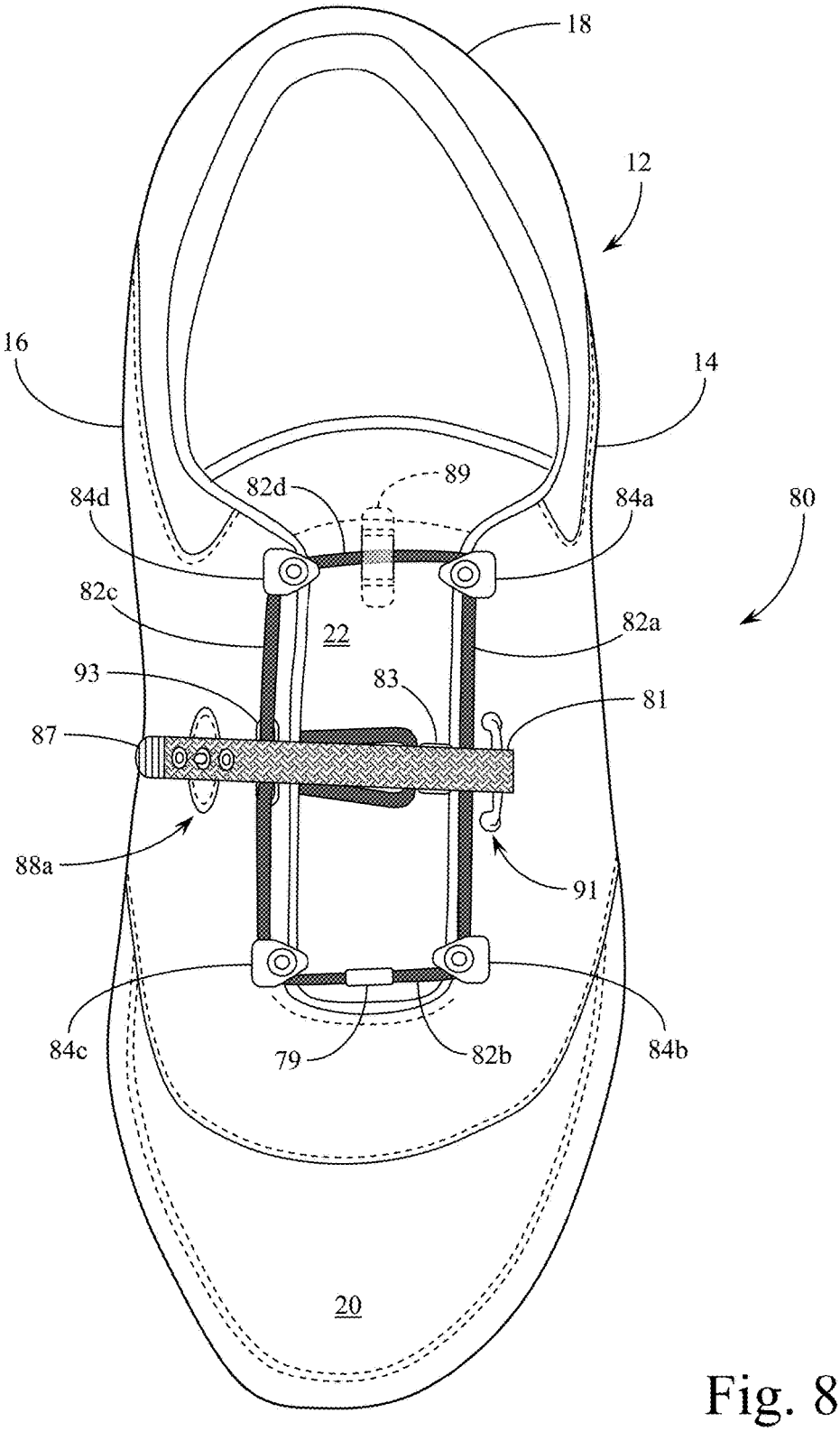
FIG. 8C is a top plan view of the third preferred embodiment of the squared-cord shoe closure system of the present invention, as provided in FIG. 8A, shown in a closed and tightened configuration.

Reference is next made to FIGS. 8A-8C for a third preferred embodiment of the squared-cord shoe closure system of the present invention incorporating a single lateral pull with securement on the side of the shoe, supplemented with an additional center eye stay closure action. In FIG. 8A, retainer bridge 91 is positioned on one side of the shoe opposite that of securement post assembly 88*a*. In addition, eye stay aperture 93 is structured through the eye stay on the same side of the shoe as securement post assembly 88*a*. Although this third preferred embodiment may be manufactured or implemented in a mirror image of the arrangement shown in FIGS. 8A-8C (i.e. the medial and lateral sides being switched) the structure does not generally lend itself to being user-reversible on a given shoe as does the previously described second preferred embodiment.

Securement strap 81 in this third preferred embodiment is attached to draw cord second longitudinal portion 82*c* through eye stay aperture 93 with strap clasp 83 as shown in FIG. 8A. In this embodiment, rather than simply being laterally drawn across the shoe, securement strap 81 initially passes under and around retention bridge 91 before it is drawn back across the shoe and attached to securement post assembly 88*a*. This additional point of tension on the first side of the shoe (lateral side 14 in the example shown) provides an additional compression force across the tongue 22 of the shoe drawing the two sides of the shoe opening and the shoe eye stays together. Here again, a balance in the elastic properties of the draw cord made up of cord portions 82*a*-82*d* should be found that provides a residual tension in the cord, but also provides enough inelastic strength to draw the two sides of the shoe together.

FIG. 8B provides the same view of shoe 12 but with the squared-cord shoe closure system 80 shown in a condition after the user has progressed generally half way through the securement process. At this point in the process, securement strap 81 has pulled the midpoint of draw cord second longitudinal portion 82*c* through eye stay aperture 93 and has thereby pulled on each side portion of the squared-cord arrangement to the point where it begins drawing the sides of the shoe together. Securement strap 81 extends under and out from retention bridge 91 prior to being directed back around retention bridge 91 towards the opposite side of the shoe. Eye stay aperture 93 is large enough to allow the passage of strap clasp 83 with the engaged portion of draw cord second longitudinal portion 82*c*.

FIG. 8C shows completion of the securement process for the third preferred embodiment where securement strap 81 extends around retention bridge 91 and back across the shoe to the point of attachment to securement post assembly 88*a*. This arrangement provides two compressive closure forces across the top of the shoe, the first being the tensioning of the squared-cord arrangement and the second being the tensioning of the strap between the eye stay aperture 93 and the retention bridge 91. The four fixed pulleys 84*a*-84*d* provide low friction corner slide points that allow the squared-cord to be drawn tight and in the process to draw the sides of the shoe together. In a supplemental manner, securement strap 81 engages a lateral line from eye stay aperture 93 to retention bridge 91 and back to securement post assembly 88*a* in a manner that also draws the sides of the shoe together to provide a snug but comfortable fit for the wearer.

Figure 9:
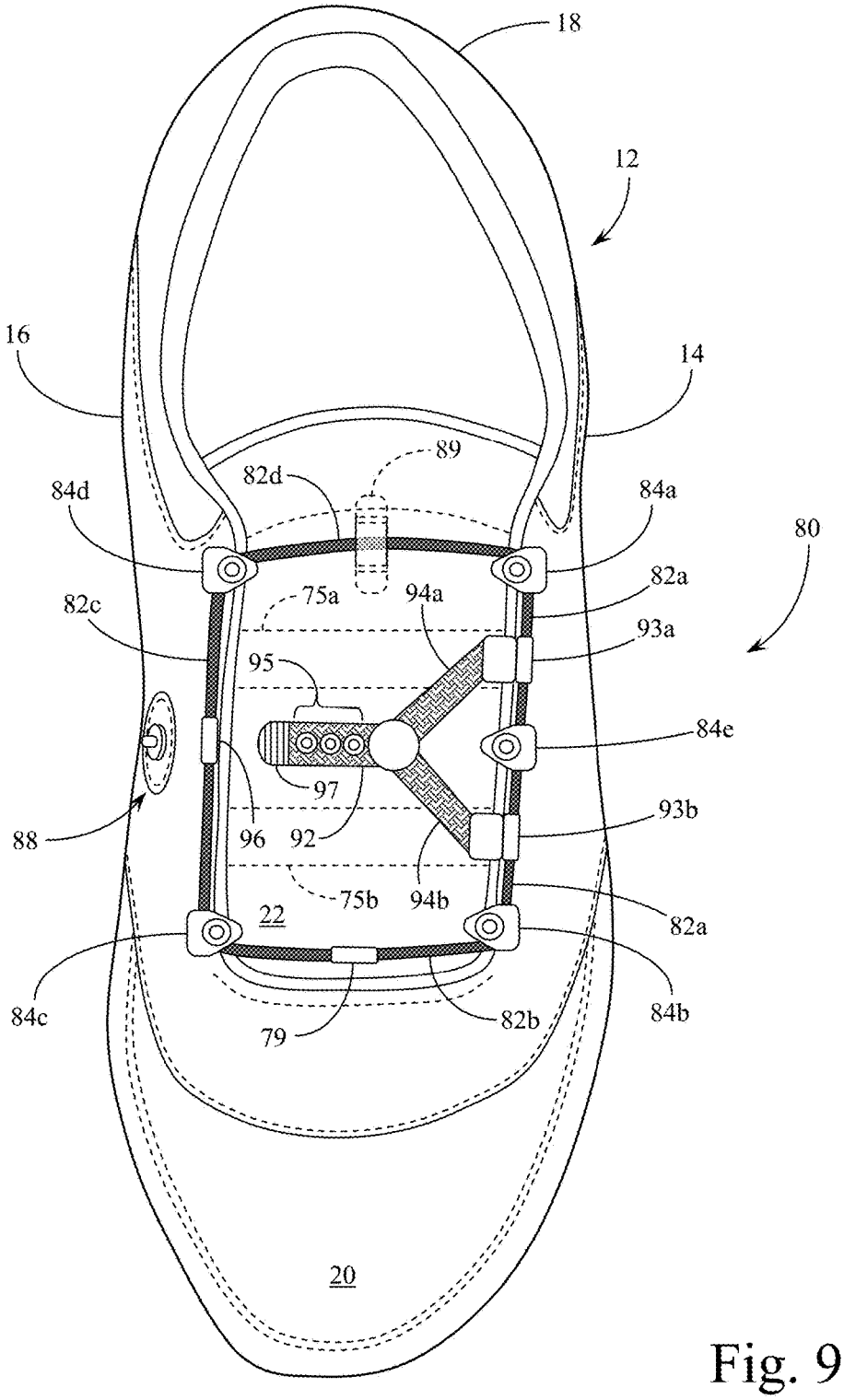
FIG. 9 is a top plan view of a fourth preferred embodiment of the squared-cord shoe closure system of the present invention, incorporating a single lateral pull acting on two sections of one side of the squared-cord component, shown in an open and loose configuration.

Reference is next made to FIG. 9 which provides an embodiment similar in many respects to the embodiment shown in FIG. 6 with the exception of the addition of a fifth fixed pulley 84*e* in the middle of draw cord first longitudinal portion 82*a*. FIG. 9 is a top plan view of a fourth preferred embodiment of the squared-cord shoe closure system of the present invention with a single lateral pull acting on two sections of one side of the squared-cord arrangement, shown in an open and loose configuration. The effect of the arrangement of the fourth preferred embodiment is to double the draw length on the squared-cord for a given lateral pull on the securement strap.

In addition to the placement of the fifth pulley (which may also be a post as described above with the various other preferred embodiments), the previous single point of connection for the securement strap is, in this fourth preferred embodiment, altered to provide two points of connection, one each at strap clasps 93*a* & 93*b*. A Y-shaped configuration for securement strap 92 now pulls twice as much cord, and therefore directs twice as much compression force, with a given lateral motion of securement strap 92. Otherwise, the configuration of securement strap 92 with pull tab 97 and hook aperture array 95 remains essentially the same as the straight strap configuration described above.

It is preferable in the embodiment shown in FIG. 9 for two elastic straps 75*a* & 75*b* to be positioned across tongue 22 between the eye stays in order to provide residual tension when the draw cord is loose, and to provide a surface over which the Y-shaped securement strap may be pulled. Otherwise, the manner of strap attachment remains essentially the same. An alternate manner of creating the Y-shaped strap configuration involves a loop of strap material forming Y-strap arms 94*a* & 94*b* onto which is hooked a straight section of securement strap 92. Various mechanisms for maintaining the Y-shaped configuration of the lateral pull securement strap 92 are anticipated.

The embodiment shown in FIG. 9 is generally not structured to allow for user modification of the direction of the lateral pull. For this reason, FIG. 9 discloses only a single securement post assembly 88 and the addition of only a single new fixed pulley 84*e*. Those skilled in the art will recognize, however, that with the addition of a sixth fixed pulley (not shown) and a second securement post assembly (not shown) the system may be configured such that the user can reverse the orientation of the Y-shaped securement strap to pull in a direction opposite that shown in FIG. 9. Certainly, the shoes may be manufactured with the medial towards lateral orientation of the pull strap and with some increased complexity may be manufactured so as to allow the user to select the direction of lateral pull.

Figure 10:
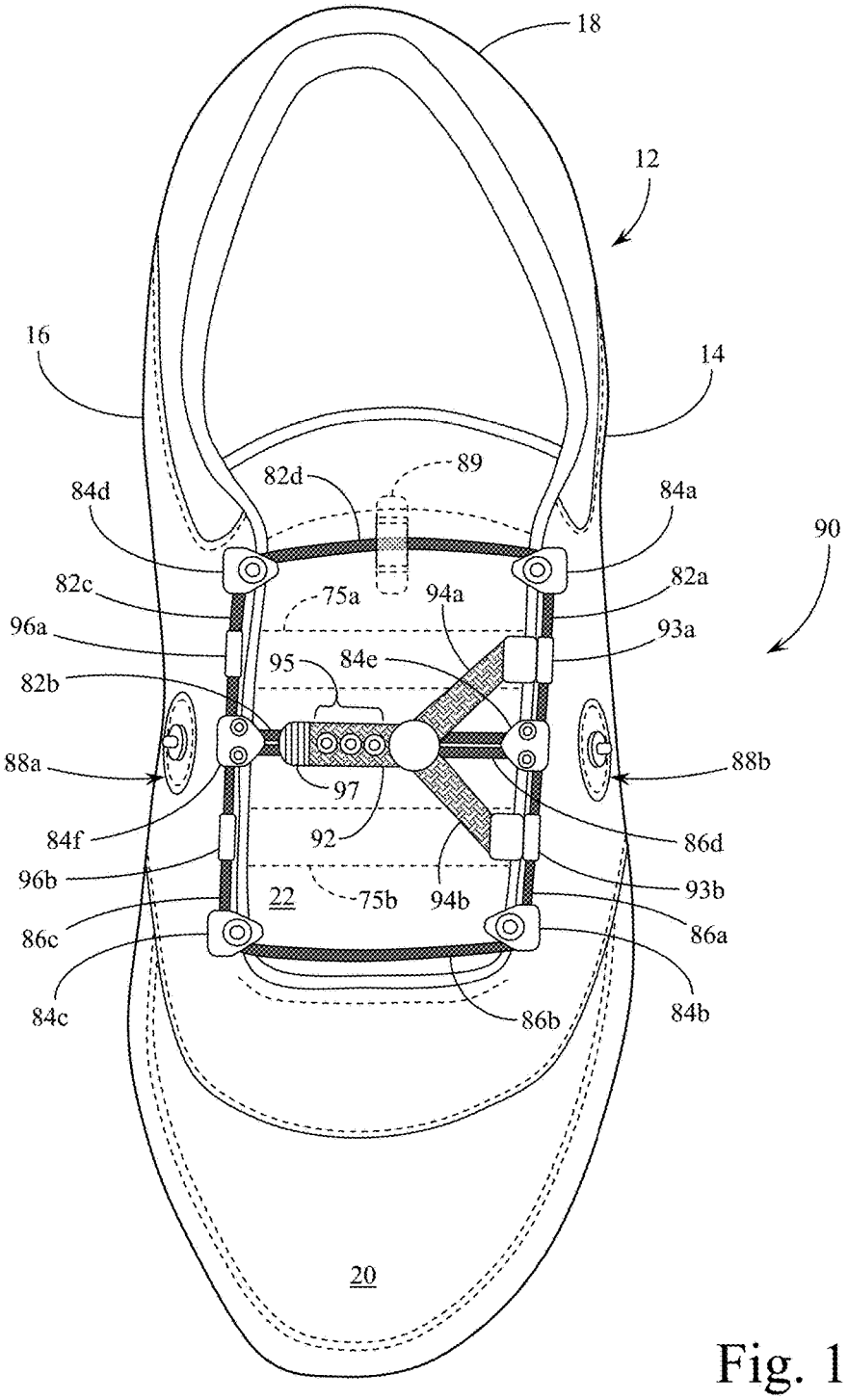
FIG. 10 is a top plan view of a fifth preferred embodiment of the squared-cord shoe closure system of the present invention, showing structures to effect a single short pull directed laterally across the shoe, drawing on multiple cords within a dual squared-cord arrangement, the system shown in an open and loose configuration.

Reference is next made to FIG. 10 which provides a Y-shaped draw strap embodiment similar to that shown in FIG. 9 except for the division of the draw cord into two separate closed loop cord components or sub-assemblies. In order to accommodate the two separate squared-cord components, two mid-shoe dual pulleys 84*e* & 84*f* are positioned on the respective eye stays of the shoe to act as corner guide posts for each of the two separate squared-cord sub-assemblies. FIG. 10 is a top plan view of a fifth preferred embodiment of the squared-cord shoe closure system of the present invention with a single lateral pull acting on the side portion of each of two separate closed loop squared-cord sub-assemblies. FIG. 10 shows this fifth embodiment in an open and loose configuration. The effect of the arrangement of this fifth preferred embodiment is to further multiply the draw length on the squared-cord components for a given lateral pull on the securement strap.

The dual squared-cord arrangement shown in FIG. 10 comprises two separate rectangular arrangements for squared-cord closure system 90 wherein the two separate closed loop cords form a double squared-cord array with a first squared-cord component made up of draw cord first longitudinal portion 82*a*, draw cord middle lateral portion 82*b*, draw cord second longitudinal portion 82*c*, and draw cord rear lateral portion 82*d*. The second lower draw cord component is made up of draw cord first longitudinal portion 86*a*, draw cord forward lateral portion 86*b*, draw cord second longitudinal portion 86*c*, and draw cord middle lateral portion 86*d*. Even though this fifth preferred embodiment provides two separate squared-cords, the function of the cord array is essentially the same as described above with the process of shortening the lateral elements of the squared-cord components serving to draw the sides of the shoe together. By drawing the longitudinal elements of the squared-cord components laterally to form angled cord elements, the longitudinal elements are lengthened as the lateral elements are correspondingly shortened.

Securement strap 92 shown in FIG. 10 includes pull tab 97, aperture array 95, and strap clips 93*a* & 93*b*. Securement strap 92 is designed to be secured alternately to draw cord first longitudinal portions 82*a* & 86*a* or draw cord second longitudinal portions 82*c* & 86*c* depending upon the direction of the lateral pull that the user desires to implement. Securement post assemblies are therefore positioned on each side of the shoe to allow the user to draw laterally across the shoe from the outside (the lateral side of the shoe) to the medial side of the shoe, or to reverse the process, directing the tightening strap laterally from the medial side towards the outside (lateral) of the shoe. Cord guards 96*a* & 96*b* provide the optional connection points on draw cord second longitudinal portions 82*c* & 86*c* onto which strap clips 93*a* & 93*b* may be alternately secured to effect the reverse of the lateral draw direction (using securement post assembly 88*b* instead of 88*a*).

The manner of connecting securement strap 92 to the side of the shoe is again provided by one of securement post assemblies 88*a* & 88*b* and is initiated by pulling laterally on securement strap 92, over and across draw cord second longitudinal portions 82*c* & 86*c*, or over and across draw cord second longitudinal portions 82*a* & 86*a*, for the reverse direction. The manner in which the securement mechanisms are utilized is essentially the same as that described above with reference to FIG. 7.

Tongue cord guide 89 and elastic bands 75*a* & 75*b* are again shown in broken lines as optional additions to the squared-cord closure system 90. In the open configuration shown in FIG. 10 elastic bands 75*a* & 75*b* are shown positioned beneath the arms of securement strap 92 in a manner that retains some tension in the system, drawing the sides of the shoe together even when the cord closure system is not tightened. Tongue cord guide 89 is also disclosed in FIG. 10 in a manner similar to the first preferred embodiment described above wherein the tongue 22 of the shoe is held up by the residual tension in draw cord rear lateral portion 82*d*.

Figure 11:
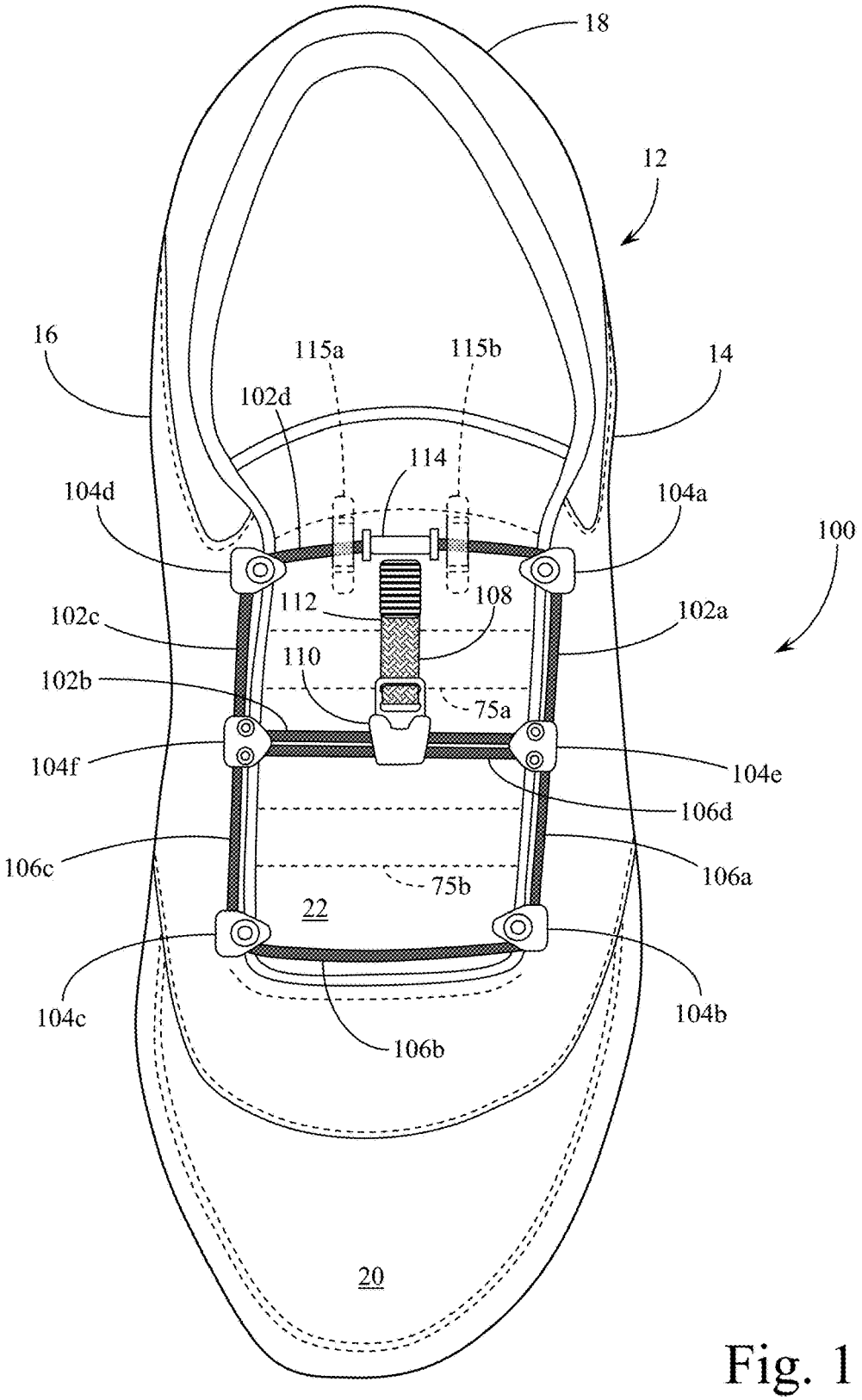
FIG. 11 is a top plan view of a sixth preferred embodiment of the squared-cord shoe closure system of the present invention, showing structures to effect a single short pull directed longitudinally up the shoe, drawing on multiple cords within a dual squared-cord arrangement, the system shown in an open and loose configuration.

Reference is next made to FIG. 11 which provides a draw cord arrangement similar to the embodiment shown in FIG. 10 but replaces the Y-shaped lateral securement strap with a single strap that is longitudinally directed for securement. FIG. 11 provides a sixth preferred embodiment of the squared-cord shoe closure system of the present invention with a single longitudinal pull acting on the lateral portions of each of the two separate squared-cord sub-assemblies. FIG. 11 shows this sixth embodiment in an open and loose configuration. The effect of the arrangement of the sixth preferred embodiment is to further multiply the draw length on the squared-cord components for a given longitudinal pull on the single securement strap.

As in FIG. 10, the squared-cord arrangements shown in FIG. 11 comprise two separate rectangular arrangements for squared-cord closed system 100 wherein the two separate closed loop cords form a double squared-cord array with a first upper squared-cord component made up of draw cord first longitudinal portion 102*a*, draw cord middle lateral portion 102*b*, draw cord second longitudinal portion 102*c*, and draw cord rear lateral portion 102*d*. The second lower draw cord component is made up of draw cord first longitudinal portion 106*a*, draw cord forward lateral portion 106*b*, draw cord second longitudinal portion 106*c*, and draw cord middle lateral portion 106*d*. While this sixth preferred embodiment provides two separate closed loop squared-cords, as does the fifth preferred embodiment described above, the function of the cord array is somewhat distinct from the embodiment shown in FIG. 10. While the upper and lower lateral cord portions continue to pull the sides of the shoe together by being shortened in the closure process, the middle lateral portions of the cord components are drawn into an angle in a longitudinal direction that has the effect of pulling together the two mid-shoe dual pulleys 104*e* & 104*f* and simultaneously pulling the longitudinal portions of the squared-cord components such that the upper and lower lateral portions are further tightened and shortened. This arrangement therefore provides yet another manner in which the squared-cords may be drawn together in the process of closing the eye stay areas of the upper together to provide a snug yet comfortable fit.

Securement strap 108 shown in FIG. 11 includes strap pull tab 112 and strap clasp 110. The point of strap securement in this case, however, is at upper slide collar 114 positioned on draw cord rear lateral portion 102*d*. The manner in which securement strap 108 connects and is secured to slide collar 114 is described in more detail below with reference to FIG. 13.

The sixth embodiment shown in FIG. 11 still benefits from the use of residual tension elastic bands 75*a* & 75*b* each positioned in connection with one of the two squared-cord components. The previous tongue cord guide, however, in this sixth embodiment is split into two tongue cord guides 115*a* & 115*b* that are positioned on either side of upper slide collar 114. Cord guides 115*a* & 115*b* therefore serve both the purpose of maintaining the position of tongue 22 beneath the draw cord assembly and the function of maintaining slide collar 114 in a centered position on the cord.

Figure 12:
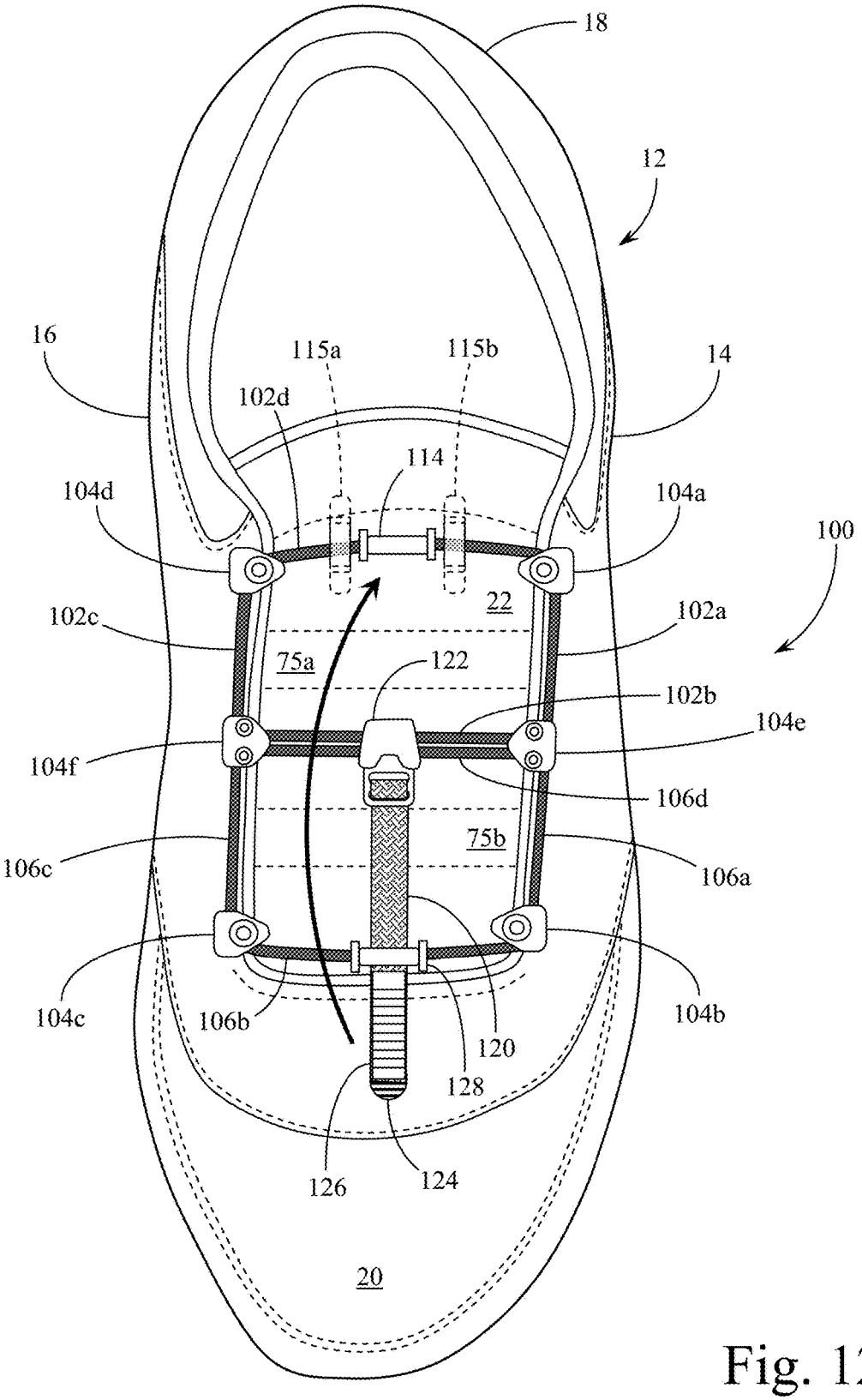
FIG. 12 is a top plan view of a seventh preferred embodiment of the squared-cord shoe closure system of the present invention, showing structures to effect a single long pull directed first longitudinally down the shoe before reversing direction longitudinally up the shoe, drawing on multiple cords within a dual squared-cord arrangement, the system shown in an open and loose configuration.

FIG. 12 is a top plan view of a seventh preferred embodiment of the squared-cord shoe closure system of the present invention, showing structures to effect a single long pull directed first longitudinally down the shoe before reversing direction up the shoe, drawing together multiple cords within a dual closed loop squared-cord arrangement, the system shown in an open and loose configuration. The basic structure of this seventh preferred embodiment is quite similar to the sixth preferred embodiment described above in connection with FIG. 11 with the addition of a lower slide collar 128 on draw cord forward lateral portion 106*b*, and the use of a longer securement strap 120 that is positioned in a reverse orientation on draw cord middle lateral portions 102*b* & 106*d*. In the configuration shown in FIG. 12, cord clasp 122 positions securement strap 120 on the middle cord portions in a manner that allows it to extend longitudinally downward towards the toe of the shoe to pass under lower slide collar 128 before being redirected around lower slide collar 128 and pulled upward to engage the upper slide collar 114 in a manner similar to the engagement of the same shown in FIG. 11. The process of tightening and closing the cord system 100 shown in FIG. 12 is an additional way of increasing the draw length on the lateral cord portions so as to increase the overall forces pulling the sides of the upper together across the tongue. In the arrangement shown, cord portions 106*d*, 106*b*, & 102*b* are drawn together with the group being drawn up to the point of connection with upper slide collar 114 on cord portion 102*d*.

Figure 13:
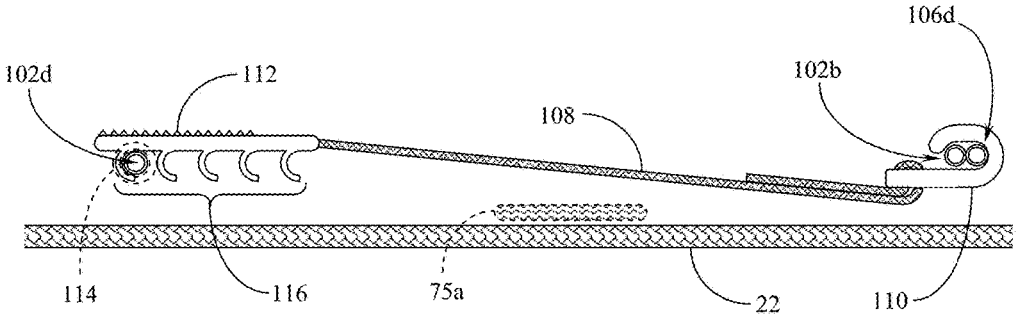
FIG. 13 is a detailed partial cross sectional view of the pull strap attachment structure for the sixth preferred embodiment of the squared-cord shoe closure system of the present invention, as provided in FIG. 11.
Figure 14:
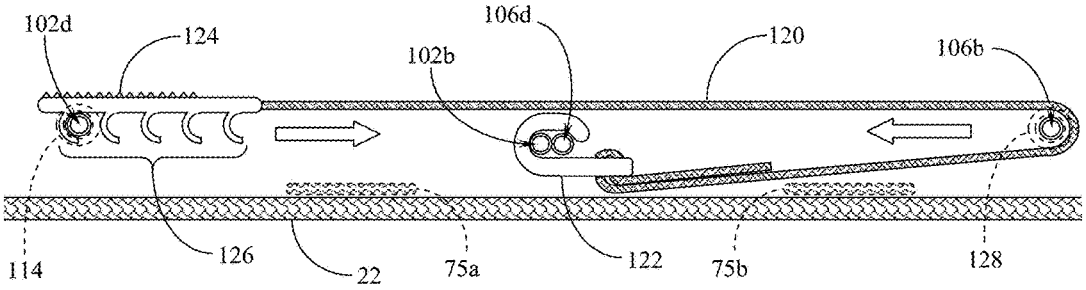
FIG. 14 is a detailed partial cross sectional view of the pull strap attachment structure for the seventh preferred embodiment of the squared-cord shoe closure system of the present invention, as provided in FIG. 12.

Lastly, reference is made to FIGS. 13 & 14 for detailed partial cross-sectional views of the pull strap attachment structures for the sixth and seventh preferred embodiments respectively. FIG. 13 shows the arrangement for the pull strap attachment structure shown in FIG. 11, whereby securement strap 108 extends between a point of connection to draw cord middle lateral portions 102*b* & 106*d* and the securement point at upper sliding collar 114 positioned on draw cord rear lateral portion 102*d*. Strap clasp 110 positioned on securement strap 108 is configured to allow the clasp and the attached strap to be securely, but removeably, fixed to draw cord middle lateral portions 102*b* & 106*d* as shown.

In the view of FIG. 13, the tongue 22 is shown with elastic band 75*a* positioned loosely over the tongue. Securement strap 108, which ends with strap pull tab 112, is configured with hook channel array 116 that provides a number of hook shaped channels sized to engage around the cylindrical structure of upper slide collar 114. By pulling upward (longitudinally) on securement strap 108, the user may selectively position upper slide collar 114 into one of the hook channels in hook channel array 116 in order to secure the strap in place. In the process, the square cord closure system is drawn together to effect a snug fit for the shoe as described above.

FIG. 14 provides a detailed partial cross-sectional view of the pull strap attachment structure of the seventh preferred embodiment shown generally in FIG. 12. In this embodiment, the longer securement strap 120 includes a similar strap clasp 122 that secures the end of the strap to draw cord middle lateral portions 102*b* & 106*d*, again preferably from below in this embodiment. Securement strap 120 then feeds down the shoe around lower slide collar 128 positioned on draw cord forward lateral portion 106*b* before extending longitudinally back up the mid-line of the shoe to a point of attachment to upper slide collar 114 positioned on draw cord rear lateral portion 102*d*. The opposing end of securement strap 120, which terminates in strap pull tab 124, is configured with hook channel array 126 that provides a number of hook shaped channels sized to engage around the cylindrical structure of upper slide collar 114. Here again, by pulling upward (longitudinally) on securement strap 120, the user may selectively position upper slide collar 114 into one of the hook channels in hook channel array 126 in order to secure the strap in place. In the view of FIG. 14, the tongue 22 is shown with elastic bands 75*a* & 75*b* positioned loosely over its upper surface. The block arrows in FIG. 14 show the manner in which the entire array of lateral cord portions are drawn together by the strap to effect the compression of the sides of the shoe for a snug fit as described above.

Those skilled in the art will recognize that although the preferred embodiments of the present invention described are generally presented with the single pull motion being effected from or on the medial side of the shoe, all such embodiments may just as easily be effected from or on the lateral (outside) of the shoe. In addition, although a number of embodiments have been described as allowing for user selected pulling direction, each of the embodiments may be implemented with or without such user selection functionality. In each case, a balance is struck between user selectability and the corresponding increase in the complexity of the squared-cord structures that will occur with mirrored securement assemblies.

While the various embodiments of the present invention have been described in connection with a shoe that incorporates a tongue positioned between parallel and opposing eye stays, those skilled in the art will recognize that the present invention may be implemented on shoes without specific tongue structures, such as shoe constructions with sides that overlap at an upper mid-line of the shoe, or in shoes not having parallel and opposing eye stays, or in shoes whose forward opening is not centered on top of the foot. As long as the corner and side point structures of the various embodiments are positioned on opposing sides of the shoe, the shoe structure in between needs only to be compressible as the sides of the assembly are drawn together. Additional variations in the specific arrangements of the squared-cord open and closed loop structures, along with the corner and side point mechanisms, will be anticipated by those skilled in the art, that still fall within the spirit and scope of the squared-cord single pull functionality of the present invention.

We claim:

1. A single pull shoe closure system that allows the wearer of a shoe to pull in a single direction to draw together the sides of the shoe across the upper of the shoe, the shoe having a width direction and a length direction, the shoe closure system comprising:

at least one length of draw cord positioned in at least a partially closed geometric arrangement across the upper of the shoe, the draw cord having at least two lateral portions extending across the width direction of the shoe, and at least one longitudinal portion extending along the length direction of the shoe between the lateral portions of the draw cord;

a plurality of guide point positioning structures slidingly engaging the at least one length of draw cord at at least two points on the at least partially closed geometric arrangement;

a draw strap having at least a lateral portion extending across the upper of the shoe;

a draw cord engagement member attached to one end of the lateral portion of the draw strap, the draw cord engagement member engaging at least one point on the at least one longitudinal portion of the draw cord; and an attachment surface positioned on the shoe, the attachment surface positioned to engage and retain a corresponding attachment surface positioned on the draw strap;

wherein the action of drawing on the draw strap and securing the attachment surfaces together effects a drawing of the lateral portion of the draw strap across the top of the shoe and thereby effects a drawing of the at least one longitudinal portion of the draw cord across the shoe so as to tighten the lateral portions of the draw cord and thereby draw together the two sides of the shoe.

2. The system of claim 1 wherein:

the draw strap further comprises a longitudinal portion extending generally at right angles to the lateral portion along the length of the shoe in the direction of a heel portion of the shoe;

the system further comprising an angle buckle fixed in position on the side of the shoe through which the draw strap is directed to effect the angle between the lateral portion and the longitudinal portion of the draw strap; and the attachment surface positioned on the shoe is positioned on a heel portion of the shoe and the corresponding attachment surface positioned on the draw strap is positioned on the longitudinal portion of the draw strap;

wherein the action of drawing rearward on the longitudinal portion of the draw strap and securing the attachment surfaces together effects a drawing of the lateral portion of the draw strap across the top of the shoe and thereby effects a drawing of the at least one longitudinal portion of the draw cord across the shoe so as to tighten the lateral portions of the draw cord and thereby draw together the two sides of the shoe.

3. The system of claim 1 wherein the at least one length of draw cord comprises a single length of draw cord with a first end and a second end, the first end attached to a first point on a first side of the upper of the shoe and extending, as a first of the at least two lateral portions of the draw cord, across the upper of the shoe to a first of the plurality of guide point positioning structures positioned on a second side of the upper of the shoe, the single length of draw cord then extending, as the at least one longitudinal portion of the draw cord, lengthwise along the upper of the shoe to a second of the plurality of guide point positioning structures positioned on the second side of the upper of the shoe, the single length of draw cord then extending, as a second of the at least two lateral portions of the draw cord, back across the upper of the shoe to a second point on the first side of the upper of the shoe, the second end of the single length of draw cord attached to the second point on the first side of the upper of the shoe.

4. The system of claim 3 wherein the first and second ends of the single length of draw cord each comprise a toggle post and the first and second attachment points on the first side of the upper of the shoe each comprise eyelets, wherein the toggle posts are removably attachable to the eyelets.

5. The system of claim 1 wherein at least one of the plurality of guide post positioning structures comprises a capped open post around which the at least one length of draw cord is engaged.

6. The system of claim 1 wherein at least one of the plurality of guide post positioning structures comprises a block and pulley through which the at least one length of draw cord is engaged.

7. The system of claim 1 wherein the draw cord engagement member is removably attached to the at least one longitudinal portion of the draw cord.

8. The system of claim 1 wherein the shoe has a tongue and the system further comprising a tongue cord guide positioned on the tongue, the at least one length of draw cord extending through and held slidingly captive within the tongue cord guide.

9. The system of claim 2 wherein the angle buckle comprises a ring member secured with a fixed strap extending from a point of attachment on the side of the shoe adjacent a sole portion of the shoe, the draw strap slidingly engaged through the ring member of the angle buckle.

10. The system of claim 2 wherein the longitudinal portion of the draw strap comprises:

a first longitudinal strap section extending from engagement with the angle buckle to terminate at an adjustment buckle; and a second longitudinal strap section extending from a point of attachment on the shoe adjacent the heel portion of the shoe, slidingly through the adjustment buckle, to terminate at the corresponding attachment surface on the draw strap;

wherein the second longitudinal strap section is drawn back, pulling on the adjustment buckle and the first longitudinal strap section, to a point where the corresponding attachment surface on the draw strap is positioned over the attachment surface on the shoe and variably secured in attachment thereto.

11. The system of claim 1 wherein the at least one length of draw cord comprises a closed loop single length of draw cord extending, as a first of the at least two lateral portions of the draw cord, from a first of the plurality of guide point positioning structures positioned on a first side of the upper of the shoe, across the upper of the shoe to a second of the plurality of guide point positioning structures positioned on a second side of the upper of the shoe, the closed loop single length of draw cord then extending, as a first of the at least one longitudinal portion of the draw cord, along the length of the upper of the shoe to a third of the plurality of guide point positioning structures positioned on the second side of the upper of the shoe, the closed loop single length of draw cord then extending, as a second of the at least two lateral portions of the draw cord, back across the upper of the shoe to a fourth of the plurality of guide point positioning structures positioned on the first side of the upper of the shoe, the closed loop single length of draw cord then extending, as a second of the at least one longitudinal portion of the draw cord, along the length of the upper of the shoe to the first of the plurality of guide point positioning structures.

12. The system of claim 11 wherein the attachment surface positioned on the shoe comprises a fixed post hook and the corresponding attachment surface positioned on the draw strap comprises a plurality of eyelets, wherein the draw strap is drawn across the shoe to position one of the plurality of eyelets onto the fixed post hook to retain the draw strap and the upper of the shoe in a tightened condition.

13. The system of claim 11 wherein the draw cord engagement member is removably attachable to either the first or second of the at least one longitudinal portion of the draw cord and the system further comprises a second attachment surface positioned on the shoe, wherein engaging the draw cord engagement member to the first of the at least one longitudinal portion of the draw cord allows attachment of the draw strap to the first attachment surface positioned on the shoe and engaging the draw cord engagement member to the second of the at least one longitudinal portion of the draw cord allows attachment of the draw strap to the second attachment surface positioned on the shoe.

14. The system of claim 11 wherein the shoe has a tongue and the system further comprising a tongue cord guide positioned on the tongue, the at least one length of draw cord extending through and held slidingly captive within the tongue cord guide.

15. The system of claim 11 further comprising:

an eye stay eyelet defining a first slot aperture positioned through a first eye stay portion of the upper of the shoe adjacent the point of draw strap engagement with the at least one longitudinal portion of the draw cord; and a retainer bridge defining a second slot aperture positioned over a second eye stay portion of the upper of the shoe laterally across the shoe from the first eye stay portion;

wherein the draw strap is threaded through the first slot aperture, drawing the draw cord through the first slot aperture and extending the draw strap laterally across the shoe, through the second slot aperture, before reversing direction back laterally across the shoe to position the corresponding attachment surface on the draw strap for attachment to the attachment surface on the shoe.

16. The system of claim 11 wherein the lateral portion of the draw strap comprises a "Y" shaped strap and the draw cord engagement member comprises first and second engagement members positioned separately one on each of two arms of the "Y" shaped strap, the system further comprising a fifth guide point positioning structure positioned generally between the second and third guide point positioning structures, the first engagement member engaging the draw cord between the second and fifth guide point positioning structures and the second engagement member engaging the draw cord between the fifth and third guide point positioning structures.

17. The system of claim 1 wherein the at least one length of draw cord comprises:

a first closed loop length of draw cord extending, as a first of the at least two lateral portions of the draw cord, from a first of the plurality of guide point positioning structures positioned on a first side of the upper of the shoe, across the upper of the shoe to a second of the plurality of guide point positioning structures positioned on a second side of the upper of the shoe, the first closed loop length of draw cord then extending, as a first of the at least one longitudinal portion of the draw cord, along the length of the upper of the shoe to a third of the plurality of guide point positioning structures positioned on the second side of the upper of the shoe, the first closed loop length of draw cord then extending, as a second of the at least two lateral portions of the draw cord, back across the upper of the shoe to a fourth of the plurality of guide point positioning structures positioned on the first side of the upper of the shoe, the first closed loop length of draw cord then extending, as a second of the at least one longitudinal portion of the draw cord, along the length of the upper of the shoe to the first of the plurality of guide point positioning structures; and a second closed loop length of draw cord extending, as a third of the at least two lateral portions of the draw cord, from a fifth of the plurality of guide point positioning structures positioned on a first side of the upper of the shoe, across the upper of the shoe to a sixth of the plurality of guide point positioning structures positioned on a second side of the upper of the shoe, the second closed loop length of draw cord then extending, as a third of the at least one longitudinal portion of the draw cord, along the length of the upper of the shoe to a seventh of the plurality of guide point positioning structures positioned on the second side of the upper of the shoe, the second closed loop length of draw cord then extending, as a fourth of the at least two lateral portions of the draw cord, back across the upper of the shoe to an eighth of the plurality of guide point positioning structures positioned on the first side of the upper of the shoe, the second closed loop length of draw cord then extending, as a fourth of the at least one longitudinal portion of the draw cord, along the length of the upper of the shoe to the fifth of the plurality of guide point positioning structures.

18. The system of claim 17 wherein the lateral portion of the draw strap comprises a "Y" shaped strap and the draw cord engagement member comprises first and second engagement members positioned separately one on each of two arms of the "Y" shaped strap, the first engagement member engaging the first closed loop length of draw cord between the second and third guide point positioning structures and the second engagement member engaging the second closed loop length of draw cord between the fifth and sixth guide point positioning structures.

19. The system of claim 18 wherein the first engagement member is removably attachable to either the first or second of the at least one longitudinal portions of the draw cord, the second engagement member is removably attachable to either the third or fourth of the at least one longitudinal portions of the draw cord, and the system further comprises a second attachment surface positioned on the shoe, wherein engaging the first and second draw cord engagement members respectively to the first and third of the at least one longitudinal portions of the draw cord allows attachment of the draw strap to the first attachment surface positioned on the shoe, and engaging the first and second draw cord engagement members respectively to the second and fourth of the at least one longitudinal portions of the draw cord allows attachment of the draw strap to the second attachment surface positioned on the shoe.

20. The system of claim 1 further comprising at least one elastic band extending between the sides of the shoe across the upper of the shoe generally parallel with the lateral portion of the draw strap.

* * * * *